United States Patent [19]

Haynes et al.

[11] 3,990,432

[45] Nov. 9, 1976

[54] LIQUID VAPORIZING METHOD AND MEANS

[76] Inventors: Beauford D. Haynes, 6454 Westlake, Dallas, Tex. 75214; Billie Joe Housewright, 719 Newell St., Dallas, Tex. 75223; James S. Jones, 1923 Ferndale Ave., Dallas, Tex. 75224

[22] Filed: Nov. 19, 1974

[21] Appl. No.: 525,281

[52] U.S. Cl. ..... 126/378; 126/350 R; 126/392; 122/39

[51] Int. Cl.[2] ..... F24H 1/40

[58] Field of Search ..... 122/39, 501; 126/350, 126/390, 392, 376, 377, 378

[56] References Cited

UNITED STATES PATENTS 1,918,113 7/1933 Lee ..... 122/39

1,972,052 8/1934 La Mont ..... 122/39

*Primary Examiner*—William E. Wayner
*Assistant Examiner*—Larry I. Schwartz
*Attorney, Agent, or Firm*—Joseph H. Schley; Thomas L. Cantrell

[57] ABSTRACT

Disclosed is a compact heat exchanger particularly useful in a vaporizer application, such as a liquefied petroleum gas fuel system. The working fluid side of the exchanger includes a vapor film area of restricted cross section, which may be located at the upstream end, downstream end, or in a mid-region of the exchanger. The vapor film area effectively dams or blocks passage of liquid droplets and thereby aids in the vaporization process.

33 Claims, 11 Drawing Figures

LIQUID VAPORIZING METHOD AND MEANS

BACKGROUND OF THE INVENTION

This invention relates to compact heat exchangers, particularly those in which the working fluid undergoes a change of state from liquid to vapor. In such exchangers a relatively high pressure drop across the exchanger on the working fluid side is not considered to be detrimental, because ample pressure energy is normally available in the liquid being vaporized to drive it through the exchanger, and a considerable pressure drop is desired in any event to utilize part of the energy stored in the liquid to supply part of the energy of vaporization.

Typical applications for such heat exchangers are as evaporators and vaporizers for liquefied petroleum, both in engine fuel systems and in gas plants. (The present invention will be discussed primarily in the context of motor fuel system type applications, although its advantages are also fully available in other applications.)

Heretofore, compactness was not a prime consideration in the design of vaporizers for liquefied petroleum for use in automotive type engines. The other parts of the fuel system were also fairly bulky, and the vaporizer, being conventionally associated with one or another of them, was customarily and conveniently made about the same size as its associated part. Thus, a fuel system with a five-inch diaphragm in the pressure regulator would likely have a five-inch diameter vaporizer attached to the regulator.

Until recently, the overall size of an engine fuel system was limited to fairly large proportions because of the use of a fixed venturi system to respond to the widely varying mass air flow demands of the engine. Recent developments in variable orifice and variable venturi techniques have made it possible to reduce the size of the fuel-air control portion of the system, and to make commensurate reductions in the size of the fuel control portion. This has led to a pressing need for compact vaporizers for such systems.

A small fuel supply system is, of course, desirable because of the crowded condition of engine compartments generally, and of automotive underhood engine compartments in particular.

Most vaporizers employed for liquefied petroleum fuel systems in the past have fallen into three classes: (a) bellows type; (b) labyrinth type; or (c) tubular type. In the bellows type liquid fuel is sprayed through a nozzle to impinge it and vapor being formed onto the internal heated walls of a bellows with a swirling action. See U.S. Pat. No. 3,176,709. Labyrinth heat exchangers are most common in larger fuel systems, where they are usually positioned between the primary and secondary pressure regulators. This type of vaporizer, as its name connotes, is usually an aluminum casting with curving intertwined grooves for the fuel and heating liquid, and an unheated metal lid closing the grooves. (See U.S. Pat. Nos. 3,184,295, and 2,832,204.) The unheated fourth side of the passages (formed by the lid) presents a condensation problem in this type of vaporizer. Tubular type vaporizers are also commonly inserted between the primary and secondary pressure regulators, although some units have loops or coils upstream from the primary regulator. This type of vaporizer has better thermal efficiency than the labyrinth type, but is more difficult and expensive to manufacture.

In the liquefied petroleum fuel field the term vaporizer is usually employed to designate a heat exchanger in which the liquid is not only converted to a vapor, but is also given some degree of superheat to prevent recondensation downstream in the fuel system. The term evaporator, on the other hand, is usually applied to a heat exchanger which creates vapor that is approximately saturated. This dichotomy in terminology is not precise, and there is some overlap in usage.

A major problem in constructing a compact heat exchanger of either type results from the fact that heat flow per unit area is a function of the temperature difference between the heating and working fluids, and of the time of exposure of the working fluid to the heated surface. In a compact heat exchanger, the residence time of the working fluid is necessarily very short because of the small volume available for the working fluid passages. The problem is more severe in vaporizers, which must not only vaporize the working fluid but add superheat to it.

SUMMARY OF THE INVENTION

In accordance with the present invention there is provided an improved compact heat exchanger especially useful as an evaporator or vaporizer. The exchanger of the invention has, in the working fluid passage, a vapor film area wherein said passage is highly constricted. The vapor film area is arranged to have a very high surface area to volume ratio (area/volume), and a fairly high length to thickness ratio, so that a dam is formed in the working fluid passage past which substantially no liquid, in the form of droplets or streams, can pass. Hereinafter, the term "vapor film area" will be used interchangeable with or be referred to as "film area" for brevity.

It is preferred that the film area of the working fluid passage have associated with it, on either the upstream or downstream sides, or both, a heated passage of larger cross section. When the enlarged passage is on the downstream side, it may be termed an "escape zone", and functions as an area in which the vapor exiting from the film area is superheated. When the enlarged passage is on the upstream side, it may be termed an "entrance zone" and functions as an area wherein a significant portion of the latent heat of vaporization is supplied to the working fluid so that, as a matter of volume, the fluid reaching the film area is largely vapor with droplets of liquid entrained therein or liquid with a large percent of the volume occupied by vapor bubbles therein. (In exchangers with the film area near the upstream end, such a fluid condition will likely exist also, although the gas/liquid proportions may differ, as a result of flashing the liquid from its storage pressure to a lower pressure just before, or just as, it enters the exchanger.)

In accordance with the invention, the high percentage of vapor entering the film area is easily accelerated to pass at high velocity through said constricted film area. The denser liquid fraction, whether in the form of streams, droplets, or froth, cannot be accelerated as rapidly to pass through the constriction. It is in effect dammed at the entrance to the film area and held there while heat is pumped into it to convert it to saturated or supersaturated vapor, or at worst, vapor with extremely tiny droplets capable of acceleration through the constriction entrained therein.

It will be clear from the discussion of particular embodiments below that in accordance with the invention film areas may be employed both upstream and downstream of pressure regulating devices, that film areas may be arranged in series, and that film area heat exchangers may be constructed integrally with pressure regulator means.

It is an object of the present invention to provide an improved heat exchanger useful as a vaporizer or evaporator which is more compact than those provided heretofore.

It is another object of the present invention to provide a vaporizer-type heat exchanger in which assurance is obtained that the working fluid will be completely vaporized in the course of its passage through the exchanger.

A further object of the invention is the provision of a vaporizer-type heat exchanger which is compact and responsive to the variations in working fluid flow rate encountered in an engine fuel system-type application.

The foregoing objects and purposes, together with other objects and purposes, can best be understood by a consideration of the detailed description which follows, together with the accompanying drawings.

DESCRIPTION OF THE PREFERRED EMBODIMENTS

Figure 4:
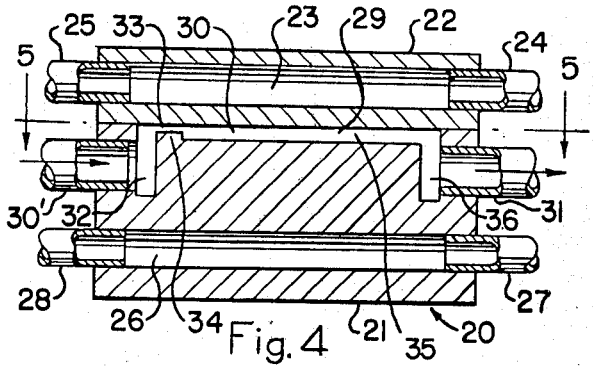
FIG. 4 is a cross sectional elevational view of another vaporizer constructed in accordance with the invention.
Figure 5:
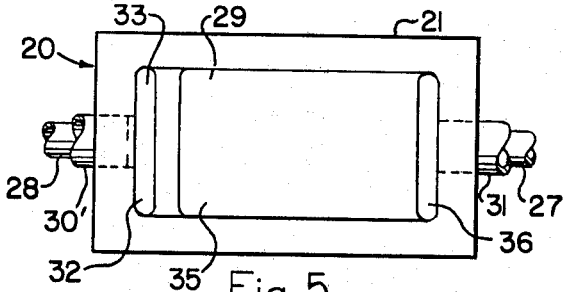
FIG. 5 is a plan view of the bottom part of the vaporizer of FIG. 4, showing most of the working fluid passage, including the vapor film area, the portion above line 5—5 of FIG. 4 being removed.

Attention is first directed to FIGS. 4 and 5, which illustrate the principles of the invention as applied to a structurally simple vaporizer. In those figures the vaporizer is designated generally as 20. It includes a lower body member 21 and an upper body member or cap 22. Both body members 21 and 22 are constructed of heat conductive material, such as aluminum. Cap 22 has a heating fluid passage 23 running horizontally therethrough, with inlet and outlet lines 24 and 25 connected to it. Lower body member 21, in its lower portion, is also provided with a heating fluid passage 26, having inlet and outlet lines 27 and 28 fitted thereto.

In the upper portion of the lower body member 21 there is formed a working fluid passage 29, which has several distinct regions or sections, each of which will be discussed. As can best be seen from FIG. 4, the top wall 30 of passage 29 is formed by part of the bottom surface of the cap 22. Working fluid passage 29 has inlet and outlet lines 30' and 31 fitted thereto. At the upstream (left) end of passage 29 is an internal header 32 of enlarged area, wherein incoming working liquid falls in pressure, is at least partially vaporized, and is distributed across the width of the passage. Immediately downstream from header 32 is the above-mentioned vapor film area 33 of passage 29, and this vapor film area is formed by rib 34 in the bottom wall of the passage which projects toward the top wall farther than any other portion of the bottom wall. The vaporous portion of the working fluid is easily accelerated through the constricted cross section of film area 33, but the liquid portion is not. It is held in header 32, wherein heat is added to it until it vaporizes and can pass as vapor through the film area.

The next region of the working fluid passage 29 in the downstream direction is escape zone or area 35 of enlarged area. In this area, the vapor which has passed through film area 33 is heated further to provide sufficient superheat to prevent condensation when the vapors encounter other and cooler parts of the fuel system downstream from the vaporizer. To the extent that very fine droplets of liquid have successfully passed through the film area 33, they are broken up into even finer droplets by the turbulence caused by the change in passage cross section and are vaporized by the heat supplied in the escape zone 35.

At the end of escape zone 35 is a second internal header 36, similar to the header 32, which gathers vapor issuing from said escape zone and conducts it to outlet line 31. (In the discussion thus far line 30' has been referred to as an "inlet" line and line 31 as an "outlet" line, in accordance with the flow directional arrows appearing on FIG. 4. However, as will appear from the discussion hereinbelow, vaporizer 20 is fully operative with the working fluid flow direction reversed, and the functional designations of lines 30' and 31 should also be regarded as reversible.)

Table I below presents vaporizer parameters and performance data for a vaporizer which was constructed generally in accordance with FIGS. 4 and 5, and which was modified from test run in the size of the film area 33. The vaporizer differed from that shown in FIGS. 4 and 5 only in that the cap 22 and lower body member 21 each had two parallel one-fourth inch diameter heating passages therethrough instead of the single passage in each member shown in the drawings, and the heating liquid accordingly made two passes through the vaporizer instead of one.

The vaporizer employed in the tests reported in Table I had a working passage facial area (defined here as the sum of the size of the film are 33, if any, and the area of escape zone 35, if any) of one-inch square, on both the top and bottom of the passage. The facial area was maintained constant throughout the series of tests, although the proportions devoted to film surface area and escape zone were varied. The height (vertical dimension) of the working fluid passage in the escape zone was 0.03 inches; the height of the passage in the film area was 0.006 inches. In accordance with the invention, the smallest dimension of the film area (usually termed its depth or height) may vary between about 0.001 inches and about 0.015 inches, depending upon the properties of the working fluid and the allowable pressure drop.

The vaporizer employed in the test, since it was designed to serve as a "test-bed" for exploration of the principles and parameters of the invention, operated at a higher pressure drop than would generally be desirable in a fuel system unit. It was intended to vaporize liquefied petroleum gas (HD5 propane — 95% propane and not over 1% propylene). The input conditions of the working fluid from storage were 65° F at 100 psig. The working fluid was passed through an upstream pressure regulator and entered the vaporizer at about 20° F and about 41 psig. The exiting fluid was at a pressure of about 6 psig. As can be seen from the table, with a film area present in the unit, under these conditions 40–50 lbs./hr. of vapor at a temperature near 55° F could be produced, utilizing heating liquid at temperatures typical of those of an engine cooling system — about 130° F to 150° F. The calculated mass liquid-to-vapor ratio across the film area is 32% liquid and 68% vapor, while the volume liquid-to-vapor ratio is 0.181% liquid and 99.82% vapor.

TABLE I

| Run | Film Area, sq. inches | Flow Direction | Heating Fluid Temp. ° F | Exit Temperature Working Fluid ° F | Flow Rate of Working Fluid, lbs./hr. |
|---|---|---|---|---|---|
| 1 | 0 | — | 150° | 28 and Falling | 47.7 |
| 2 | 1 | — | 135° | 54 | 45.8 |
| 3 | 0.5 | Film area first | 138° | 54 | 47.0 |
| 4 | 0.25 | Film area first | 147° | 54 | 46.9 |
| 5 | 0.125 | Film area first | 148° | 56 | 47.6 |
| 6 | 0.125 | Film area last | 150° | 54 | 48.1 |

From Table I it can be seen that with no film area, the vaporizer was unable to produce vapor at the desired rate and temperature (Run 1). The output temperature fell continuously and was 28° F (unusable for fuel system purposes) when the run was terminated.

A comparison of Run 1 with Runs 2 through 6 taken together, shows that the film area provided in accordance with the invention converts the device from one inoperative for its intended purpose to one capable of delivering vapor at appropriate temperatures and rates for use in a fuel system for a moderate sized engine. Runs 5 and 6 show that the beneficial effects of the film area are obtained whether it is positioned at the upstream end of the passage or the downstream end. Runs 2 through 6 show that the area and proportionate area of the film area are not critical to the operation of the invention, but they also show that some improvement in throughput capacity is obtained if an enlarged passage is provided downstream (Runs 3–5) or upstream (Run 6) of the film area. The vaporizer employed in the tests of Table I successfully operated in a fuel system for a 162 cubic inch engine.

Figure 6:
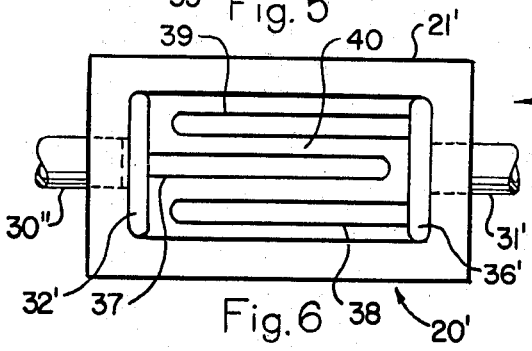
FIG. 6 is a plan view similar to FIG. 5, showing another form for the working fluid passage of another embodiment of the invention similar to that of FIGS. 4 and 5.

Attention is now directed to FIG. 6, which shows in plan view the lower body member 21' of a vaporizer 20' which has a basic structure much like that of vaporizer 20 shown in FIGS. 4 and 5. For this reason, some of the parts of lower body member 21' are given the same reference characters with a "prime" designation. Interdigitated grooves 37, 38 and 39 are cut into the bottom facial area of the working fluid passage. Groove 37 is an extension of inlet header 32'. Grooves 38 and 39 are extensions of outlet header 36', and when working fluid flow is from left to right as FIG. 6 is drawn, grooves 38 and 39 function as the escape zone or area of the working fluid passage. When flow is from right to left as FIG. 6 is drawn, groove 37 functions as the escape zone or area. The film area 40 occupies the remainder of the facial area of the bottom of the working passage. The frontal area of the film area in the embodiment of FIG. 6 is thus about 3 times greater than the frontal area of the film area 33 in the embodiment of FIGS. 4 and 5.

A vaporizer constructed in accordance with FIG. 6 successfully produced vapors at a temperature of 60° F and at a rate of 48.1 pounds per hour, using a heating liquid temperature of 145° F, operating in a system in which the primary pressure drop in the working fluid occurred upstream of the vaporizer. Another test run was made with the principal pressure drop in the working fluid occurring downstream of the vaporizer. In this run the vaporizer produced vapor at a temperature of 55° F at a rate of 47 pounds per hour, with a heating liquid temperature of 135° F. These two test runs, taken together, demonstrate that the vaporizer of the invention functions well at both high and low working fluid pressures.

Figure 8:
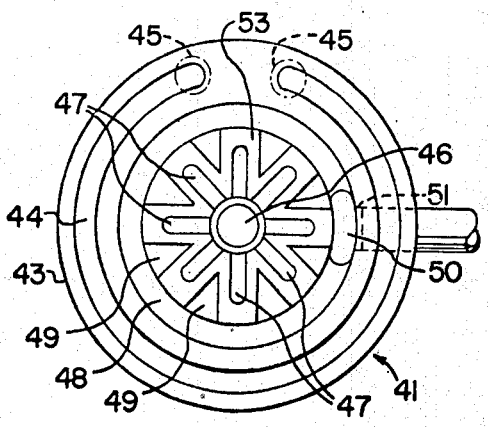
FIG. 8 is a plan view of the bottom part of the heat exchanger of FIG. 7, the portion above line 8—8 of FIG. 7 being removed.
Figure 7:
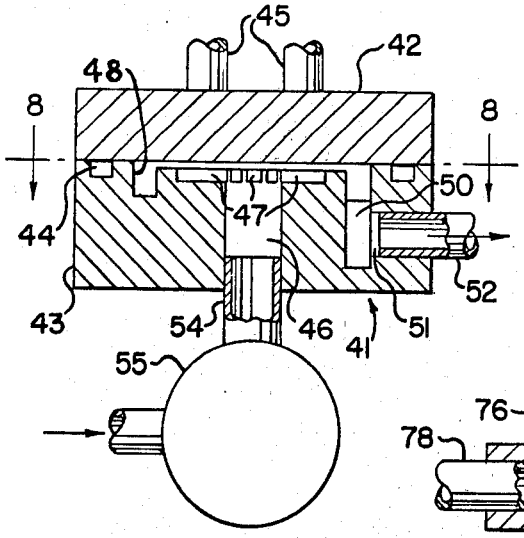
FIG. 7 is a front elevational view, partly in section, of a circular labyrinth-type vapor film area heat exchanger constructed in accordance with the invention.

In FIGS. 7 and 8 there is shown a circular vaporizer 41 constructed in accordance with the invention. It includes an upper body member or cap 42, and a lower body member 43. The upper surface of lower body member 43 has a circumferential heating fluid passage groove 44 formed in it. Groove 44 is closed on its top side by cap 42. Heating fluid is introduced to and removed from groove 44 through lines 45 which pass downwardly through cap 42 as indicated by the dotted outlines in FIG. 8.

The lower body member 43 has a central inlet bore 46 passing upwardly therethrough, which forms a portion of the working fluid passage through the unit. A pattern of radial grooves 47 is formed in the upper surface of lower body member 43 so that the inner ends of the grooves are in communication with bore 46. Also formed in the upper surface of lower body member 43 is a circumferential groove 48 which forms part of the working fluid passage. Groove 48 is positioned radially inwardly from heating fluid groove 44, and radially outwardly of bore 46 and the communicating radial grooves 47 (see FIG. 8). A series of wedge-shaped notches 49 is formed in the upper surface of lower body member 43 in the spaces between radial grooves 47. The outer edges of notches 49 communicate with groove 48. An internal header 50 is also formed in lower body member 43 in communication with circumferential working fluid passage groove 48. A bore 51 intercepts header 50 from the side, and an outlet line 52 is fitted in bore 51. Between the radial grooves 47 and notches 49, the upper surface of lower body member 43 constitutes a film area 53. An inlet line 54 is fitted into bore 46 and a pressure regulator 55 for dropping the pressure of incoming working fluid is provided in line 54.

From the foregoing description, it can be seen that when cap 42 is placed over lower body member 43 a closed flow path for working fluid is established which includes inlet line 54, bore 46, grooves 47, film area 53, notches 49, groove 48, header 50, bore 51, and outlet line 52.

A vaporizer constructed as shown in FIGS. 7 and 8 having a facial area (the area radially inwardly of groove 48) of 1.5 square inches was capable of producing vapors at 50° F at a rate of 65.7 pounds per hour using a heating liquid temperature of 128° F.

Figure 9:
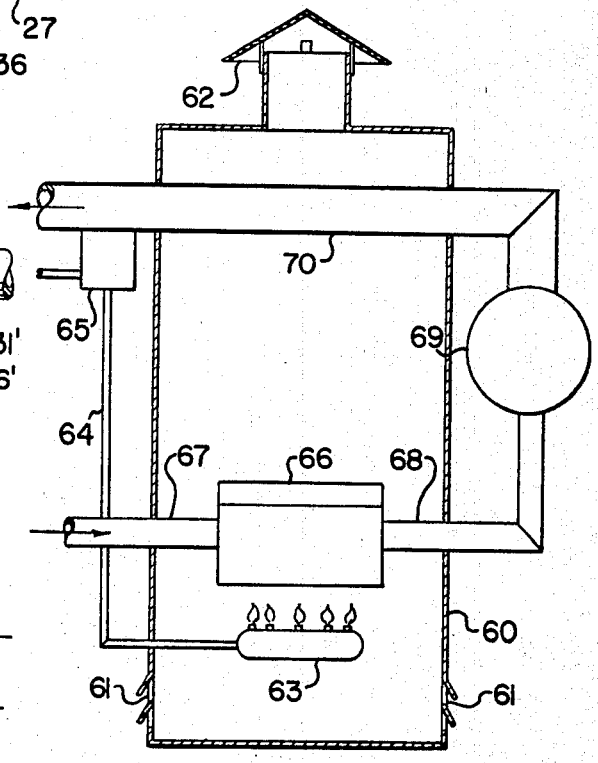
FIG. 9 is a diagrammatic elevational view, partly in section, showing the use of a heat exchanger of the invention in a typical gas plant.

FIG. 9 illustrates somewhat diagrammatically the application of the vaporizer of the invention to a gas plant, as contrasted with the fuel system applications of the invention discussed thus far. The gas plant includes a cabinet or housing 60, having air inlets 61 and an exhaust stack 62. Mounted inside of cabinet 60 is a gas burner 63 having a supply line 64 and a controller 65.

A vaporizer 66 is mounted in the cabinet above burner 63 in position to receive heat therefrom. The vaporizer 66 may be of the general structure of the vaporizers discussed above in connection with FIGS. 4 through 8, or the structures disclosed in FIG. 10 or FIG. 1, discussed below, with the heating fluid passages omitted, since the body of the vaporizer is heated by radiant and convective heat transfer from the burner 63. Working fluid is introduced to the vaporizer through line 67, and withdrawn therefrom through line 68. It then is dropped in pressure through regulator 69 and is passed through line 70 back through the cabinet 60 of the gas plant for additional superheating. It is then led through line 70 to a point of use. A portion of the gas or vapor in line 70 is drawn off through burner control 65 for delivery to burner 63.

Figure 10:
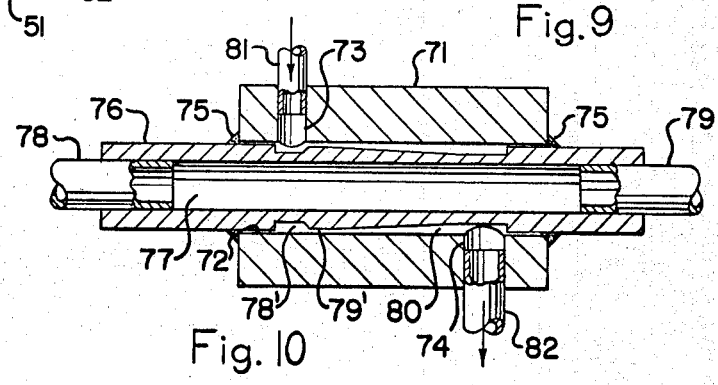
FIG. 10 is a cross sectional elevational view of still another embodiment of the heat exchanger of the present invention.

FIG. 10 illustrates the application of the principles of the invention to a tubular or annular-type heat exchanger configuration. This configuration is in contrast to that of the embodiments of FIGS. 4 through 8 where at least a major part of the working fluid passage is arranged to provide for planar flow of the working fluid.

The exchanger of FIG. 10 includes a tubular outer body 71 having an axial bore 72 and side bores 73 and 74 intercepting the axial bore 72, one near one end of the member 71 and the other near the other end. Mounted in axial bore 72, as by welding 75, is inner tubular body member 76. Member 76 is provided with an axial bore 77 and inlet and outlet lines 78 and 79 are fitted in the ends thereof. The axial bore 77 of inner tubular member 66 constitutes the heating fluid passage of the exchanger, and since flow of the heating fluid may be in either direction through that passage, lines 78 and 79 may each be given alternate functional designations. Thus, line 78 is an inlet line or an outlet line depending upon the flow direction of heating fluid.

The outer surface of inner tube 76 is developed as shown in FIG. 10 so that an entrance zone or internal header (annular in shape) is formed adjacent side bore 73. The internal header is designated 78'. Also formed in axial passage 72 by the development of the outer surface of tube 76 is an annular film area 79', and an escape zone 80 which extends to a point adjacent the other side bore 74. Lines 81 and 82 are fitted into side bore 73 and 74, respectively. The arrows appearing on FIG. 10 indicate a flow of working fluid into the unit through line 81 and out of it through line 82. It should be understood, however, that the flow of working fluid may be in the other direction, in which event escape zone 80 becomes an entrance zone.

From the foregoing description it can be seen that the embodiment of the invention shown in FIG. 10 employs the same principles and features as the embodiments discussed earlier, including those of a film area and adjacent entrance and escape zones in the working fluid passage.

Figure 1:
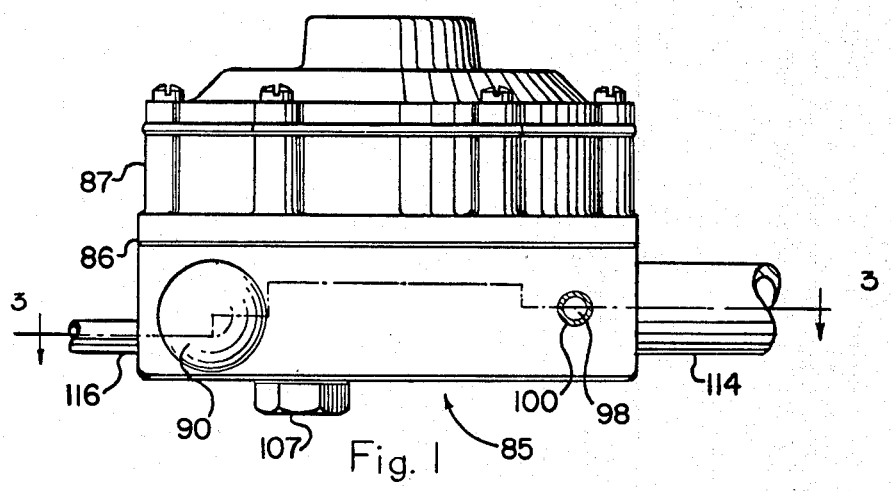
FIG. 1 is a front elevational view of a combined control valve and vaporizer constructed in accordance with the invention.
Figure 2:
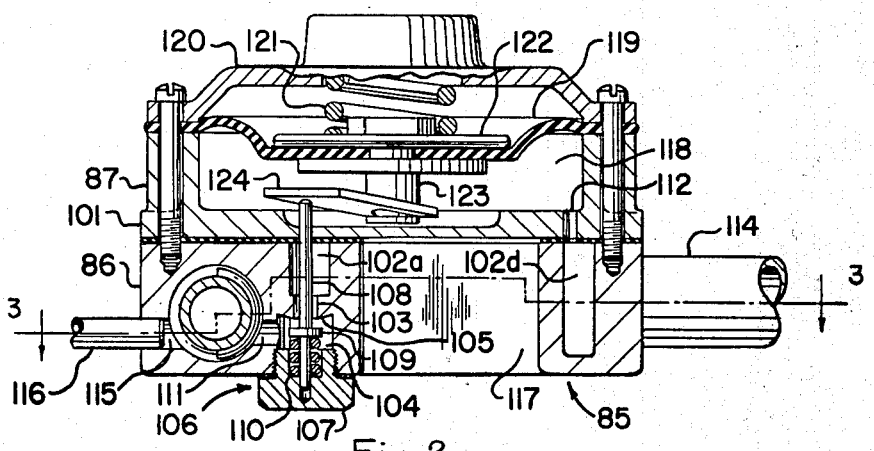
FIG. 2 is a front elevational view, partly in section, of the combined control valve and vaporizer of FIG. 1, the section being taken on a line 2—2 of FIG. 3.
Figure 3:
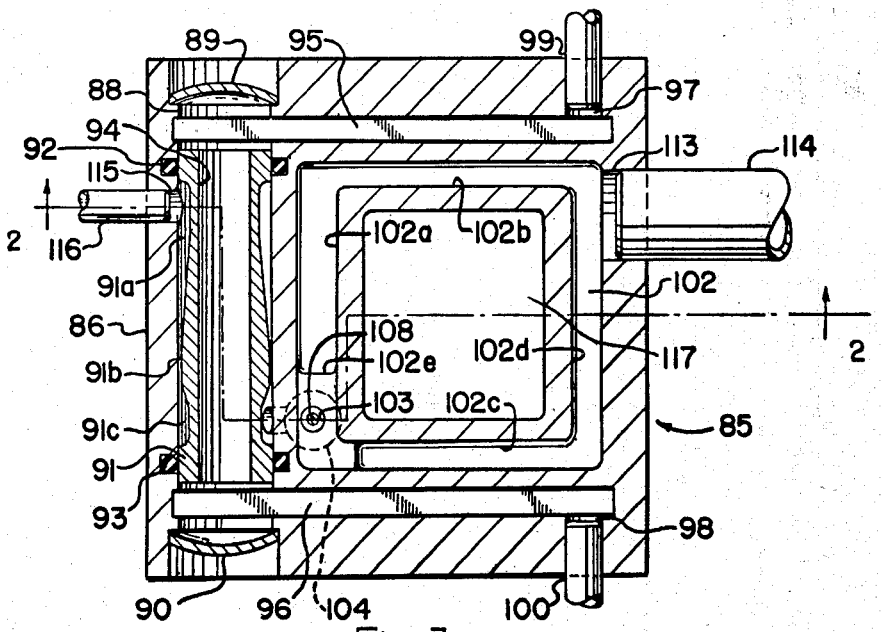
FIG. 3 is a sectional plan view of the vaporizer portion of the device of FIGS. 1 and 2, the section being taken on the lines 3—3 of FIGS. 1 and 2.

FIGS. 1 through 3 illustrate a vaporizer of the invention combined in a unitary device with a pressure actuated control valve. In FIGS. 1 through 3 the vaporizer unit is designated generally as 85. Vaporizer 85 is constructed in two main sections, the vaporizer proper 86, and the regulator or control valve section 87.

The vaporizer proper 86, as can be seen from FIGS. 1 through 3, is formed of a generally prismatic rectangular block of material. At one side of the block a horizontal bore 88, closed at its ends by freeze plugs 89 and 90, is provided. A tubular insert 91 is mounted in bore 88 by means of O rings 92 and 93. Tubular insert 91 has an axial bore therein 94, and has a developed outer surface much like that of inner tubular member 76 of the embodiment of FIG. 10. The function of the developed surface is discussed later hereinbelow. Two parallel grooves are formed in the top surface of the block of material forming the vaporizer proper 86, which grooves intercept bore 88. In FIG. 3 these grooves are designated 95 and 96. At the ends of the grooves remote from their interceptions of groove 88, side bores 97 and 98 are provided which intercept grooves 95 and 96, respectively. Lines 99 and 100 are fitted in bores 97 and 98. The top side of grooves 95 and 96 is closed by lower body member 101 of the control valve portion 87 of the unit.

From the foregoing description it can be seen that the heating fluid circuit through vaporizer proper 86 proceeds through line 99, bore 97, groove 98, axial bore 94 of tubular insert 91, groove 96, bore 98, and line 100. It should be understood that the flow path of heating fluid may be reversed from that just traced, if desired.

In the block of material forming vaporizer proper 86, in the portion thereof beside axial bore 88, there is formed in the top surface a relatively deep rectangular groove 102. For convenience in discussion, the four legs of groove 102 are labeled **102*a*, 102*b*, 102*c*, and 102*d*. In the corner of groove 102 formed by legs 102*a* and 102*c*, the floor of the groove is elevated somewhat, this elevated region being designated 102*e*. A hole 103 is provided in the floor of groove 102 in the region 102*e*. Immediately beneath hole 103 is a valve bore 104 of larger diameter than hole 103**.

The upper end of valve bore 104 forms a valve seat 105 surrounding the lower end of hole 103. A valve assembly designated generally 106 is threadedly mounted in valve bore 104. Valve assembly 106 includes a cap 107, a valve stem 108, a valve member 109, and a valve spring 110. As can best be seen in FIG. 2, valve stem 108 passes through hole 103. It is somewhat larger in diameter above valve member 109 than it is below it, and valve spring 110 is positioned to work between valve member 109 and valve cap 107. Valve spring 110 is biased to urge valve member 109 upwardly to a closed position against valve seat 105. Valve stem 108 is of a length sufficient to extend into the control valve section 87 of the vaporizer as is discussed below. A crossbore 111 connects valve bore with axial bore 88.

Lower body member 101 of the control valve section 87 closes the top of groove 102. A hole is provided so that valve stem 108 may project upwardly through lower body member 101, and a second hole 112 is provided to establish fluid communication between groove 102 and the control valve section 87. A side bore 113 intercepts groove 102, and particularly leg 102*d*, approximately diagonally across the rectangle of groove 102 from hole 103. Output line 114 is fitted in bore 113. Another side bore 115 intercepts axial bore 88, and an inlet line 116 is fitted in it.

The developed outer surface of tubular insert 91 establishes, with inner surface of bore 88, an annular working fluid passage, including an entrance zone 91*a*, a film area 91*b*, and a small escape zone 91*c*.

From the foregoing description, it can be seen that the flow path through vaporizer proper 86 for working fluid is as follows: Inlet line 116, bore 115, axial bore 88 (in the annular space outside of the developed surface of tubular member 91) bore 111, valve bore 104, hole 103 (assuming valve member 109 to be open) groove legs 102*a* and 102*b* or groove legs 102*c* and 102*d*, bore 113, and outlet line 114. The working fluid is therefore in single-walled heat exchange contact with heating fluid during its traverse of bore 88 and legs 102*b* and 102*c* of groove 102, and in somewhat more indirect heat exchange contact with the heating fluid in its traverse of legs 102*a* and 102*d* of groove 102.

Within the perimeter defined by rectangular groove 102, a hole 117 is provided in vaporizer proper 86 to save weight and material.

The control valve section 87 includes beforementioned lower body member 101, which has a cylindrically shaped hollow interior 118. The open top of interior 118 is closed by a flexible diaphragm 119. Above diaphragm 119 is a cap 120, having an opening therein communicating with the atmosphere. A diaphragm biasing spring 121 works between cap 120 and a washer 122 on the upper surface of diaphragm 119. Shaft 123 is mounted to depend from the lower side of the diaphragm, and arm 124 extends laterally from shaft 123 to contact and bear against valve stem 108.

With the foregoing description of the structure of the unit of FIGS. 1–3 in hand, its operation can now be outlined. Heating liquid from the engine cooling system enters through line 99 or 100 and leaves through the other. Liquid or partially vaporized working fluid enters through line 116. Its vapor fraction is increased as it passes through entrance zone 91*a*, and its vaporization is substantially completed as it passes through the film area 91*b* in the manner explained above. The vapor then passes through the valve 106 and into rectangular groove 102, where it is superheated before exiting through line 114.

The bias of spring 121 in control valve section is selected so that it, when added to the pressure of the atmosphere above diaphragm 119, establishes a suitable (and selected) positive pressure in the working fluid passage by holding valve member 109 away from seat 105. If the working fluid pressure exceeds the desired level or range, valve member 109 will close against seat 105. When the pressure in the vapor system falls, as occurs when an engine increases its demand for fuel, the diaphragm moves downwardly against the decreased pressure under the influence of the atmosphere and its bias spring to increase the gap between valve member 109 and valve seat 105, thereby increasing the vapor flow rate and ultimately the vapor sytem pressure.

At low flow rates, vaporization of the working fluid is completed and some superheating of the vapor is accomplished in, and even upstream of, the film area 91*b*. As the flow rate of the working fluid increases, less superheating is achieved in the film area, and at very high flow rates, droplets of liquid may even move downstream of the film area. But these are instantly vaporized as they are flashed through hole 103 of the valve, and superheat is added as the vapor traverses groove 102.

Figure 11:
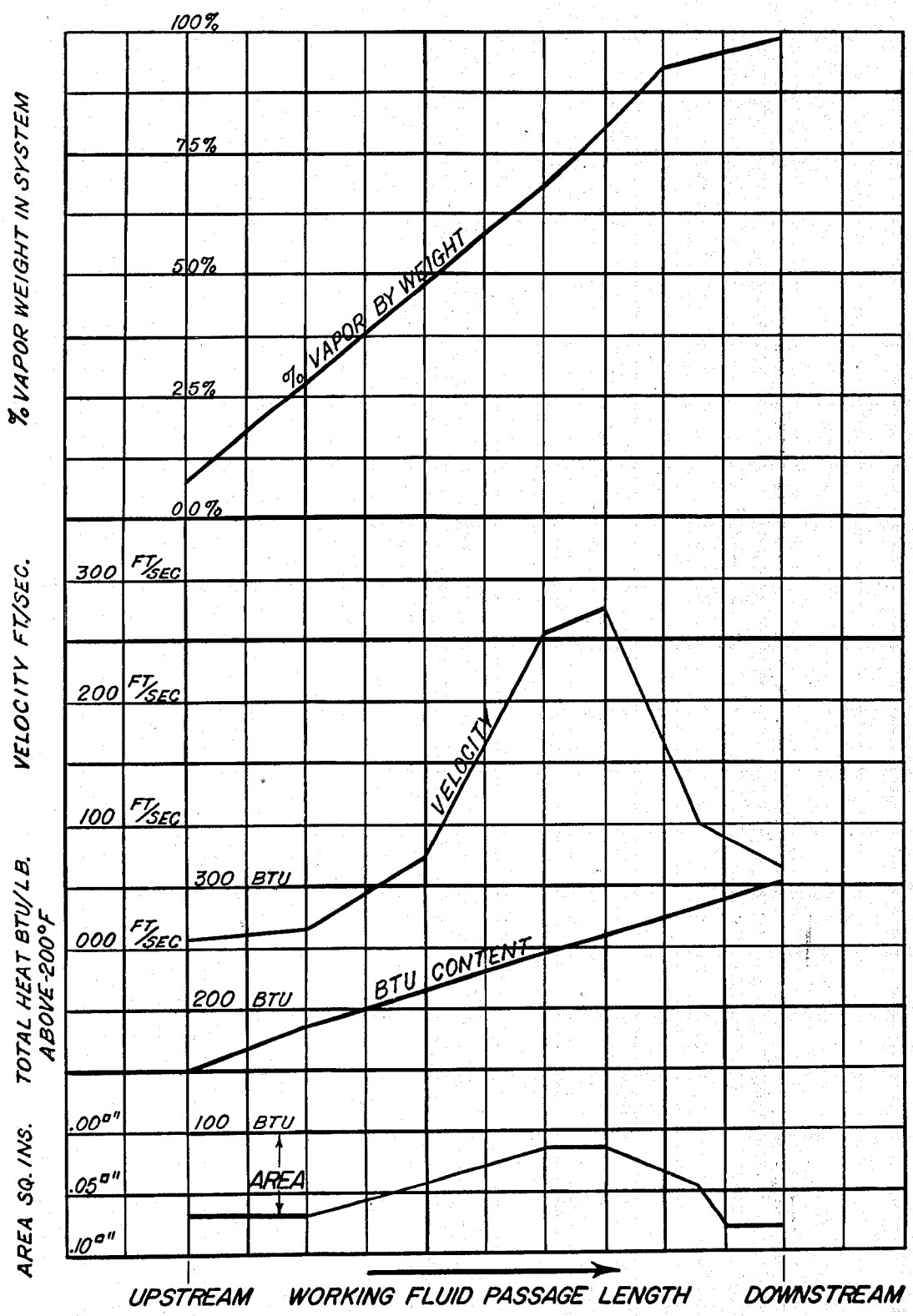
FIG. 11 is a graph plotting for illustration variations in several parameters of the working fluid, and one dimensional parameter of the vaporizer, as a function of vaporizer working fluid passage length, for a typical heat exchanger or vaporizer of the invention.

FIG. 11 presents a series of curves showing vapor parameters, and their manner of variation as the working fluid moves from upstream to downstream through the vaporizer. Also presented is a curve plotting the cross sectional area of the working fluid passage throughout its relevant length. The curves are based upon the maximum design point of a vaporizer having a 100 lb./hr. capacity with a delivery temperature of 60° F, handling propane.

In the bottom curve, the distance between the heavy line at area = 0.00 square inches and the curve represents the cross sectional area of the working fluid passage. It can be seen that the vaporizer includes both an entrance zone upstream of the film area, and an escape zone downstream from it.

The curve labelled BTU content shows that heat is continually pumped into the working fluid as it moves through the vaporizer. This heat is devoted to vaporizing increasing amounts of the working fluid, as is illustrated by the curve labelled % vapor by weight.

The curve labelled velocity shows that the mean velocity increases rapidly as the film area is approached and traversed, due both to the decreased cross sectional area of the passage and to the increasing vapor fraction of the material. The vapor can easily be accelerated to the velocities represented on this curve in the neighborhood of the film area, with only a few pounds of pressure drop, but to accelerate the liquid in the same manner, a pressure drop of a few hundred pounds would be required. The liquid is therefore dammed at the entrance of the film area until it is vaporized or at least reduced to fine droplets capable of passing through the film area and readily vaporizable downstream in the system from it.

What is claimed is:

1. A heat exchanger for converting a flowing fluid from a liquid or liquid-vapor mixture to a vapor by addition of heat thereto comprising:

a housing having working fluid inlet and outlet means therein and a working fluid passage extending therebetween, the working fluid passage having at least a pair of opposed coacting wall portions which are spaced uniformly from each other and each of which wall portions have a dimension extending in the direction of the flow of fluid through said passage, means for delivering heat to at least some wall portions of said working fluid passage, said working fluid passage including at least one vapor film area substantially coextensive with one of its transverse dimensions in which at least one of said wall portions of said passage closely approaches the opposed wall portion thereof to reduce the transverse depth of said passage to a constricted cross-section so as to create a pressure drop across the vapor film area and thereby block substantial flow of liquid across said vapor film area, said transverse depth of the constricted vapor film area of said passage being uniform throughout said substantially coextensive transverse dimension of said passage whereby channelling of the flow through said area is prevented, said vapor film area having a dimension extending longitudinally of said working fluid passage which is much greater than said transverse depth of said area and much less than the length of said passage.

2. Apparatus in accordance with claim 1 in which said heat delivery means is a burner positioned to direct heat onto said housing.

3. Apparatus in accordance with claim 1 in which said heat delivery means comprises at least one internal heat exchange fluid passage in said housing.

4. Apparatus in accordance with claim 1 and further comprising an enlarged heated escape zone in said working fluid passage downstream from said vapor film area.

5. Apparatus in accordance with claim 1 and further comprising an enlarged heated entrance zone in said working fluid passage upstream from said vapor film area.

6. Apparatus in accordance with claim 1 in which said working fluid passage includes a planar region.

7. Apparatus in accordance with claim 1 in which said working fluid passage includes an annular region.

8. An apparatus in accordance with claim 1 and further comprising pressure control valve means in said working fluid passage.

9. Apparatus in accordance with claim 1 in which the smallest dimension of said constricted cross section is between about 0.001 and about 0.015 inches.

10. Apparatus in accordance with claim 1 in which the smallest dimension of said constricted cross section is about 0.006 inches.

11. Apparatus in accordance with claim 8 in which said pressure control valve means is upstream from said vapor film area.

12. Apparatus in accordance with claim 8 in which said pressure control valve means is downstream from said vapor film area.

13. A heat exchanger as defined in claim 1 wherein said vapor film area formed by the reduced portion of said working fluid passage is annular.

14. A heat exchanger as defined in claim 13 wherein said working fluid passage has a cylindrical portion concentrically surrounding said vapor film area.

15. A heat exchanger as defined in claim 14 comprising a tubular member concentrically disposed in the cylindrical portion of said working fluid passage and having its exterior contoured to provide the constricted cross section of said vapor film area, the tubular member having its bore communicating with the heat delivering means.

16. A heat exchanger as defined in claim 1 comprising a tubular member, said working vapor fluid passage having a cylindrical portion in spaced concentric relation to the tubular member whereby the space therebetween and the constricted cross section of said film area are annular, said tubular member having its bore communicating with the heat delivering means.

17. A heat exchanger as defined in claim 16 comprising pressure control means communicating with said working fluid passage for reducing the pressure of the working fluid.

18. A heat exchanger as defined in claim 1 comprising pressure control means communicating with said working fluid passage for reducing the pressure of the working fluid.

19. A heat exchanger as defined in claim 18 wherein the pressure control means is disposed upstream of said working fluid passage.

20. A heat exchanger as defined in claim 18 wherein the pressure control means is disposed downstream of said working fluid passage.

21. A heat exchanger as defined in claim 1 wherein said working fluid passage includes heated zones both upstream and downstream of said vapor film area, the upstream zone preheating the fluid so as to increase the vaporization thereof, the downstream zone super-heating the vapor so as to minimize subsequent liquefying thereof.

22. A heat exchanger as defined in claim 21 wherein each of the heated zones of said working fluid passage is enlarged relative to the constricted cross section of said vapor film area.

23. A heat exchanger as defined in claim 1 wherein said working fluid passage includes a planar region downstream of and of much greater area than said vapor film area.

24. A heat exchanger as defined in claim 23 comprising means coextensive with the major transverse dimension of the planar region of said working fluid passage for reducing said passage to provide the constricted cross section of said vapor film area.

25. A heat exchanger as defined in claim 24 wherein said working fluid passage includes heated zones both upstream and downstream of said vapor film area, the upstream zone preheating the fluid so as to increase the vaporization thereof, the downstream zone super-heating the vapor so as to minimize subsequent liquefying thereof.

26. A heat exchanger as defined in claim 1 wherein said working fluid passage includes separate interdigitated portions, a least a first one of the interdigitated portions of said passage communicating with the working fluid inlet means, at least a second one of said interdigitated passage portions communicating with the working fluid outlet means, said vapor film area of said working fluid passage being disposed between the first and second interdigitated passage portions.

27. A heat exchanger as defined in claim 1 wherein at least a portion of said working fluid passage is of labyrinth configuration.

28. A heat exchanger as defined in claim 27 wherein the labyrinth portion of said working fluid passage has a plurality of radial portions and a circular portion surrounding the radial portions, the radial and circular portions communicating with one each of the working fluid inlet and outlet means, said vapor film area of said working fluid passage being disposed between said radial and circular passage portions.

29. A heat exchanger as defined in claim 1 comprising rib means extending transversely from one of the aforesaid wall portions of the working fluid passage so as to closely approach the opposed wall portion of said passage and thereby constrict its transverse area to perovide the aforesaid vapor film area.

30. The method of converting a flowing pressurized fluid from a liquid or liquid-vapor mixture to a vapor which comprises conducting the flow of the pressurized fluid in heat exchange relation to a source of heat, constricting the flow of said fluid at a predetermined interval in said flow to provide a vapor film area having an extremely high surface area-to-volume ratio and a moderately high length-to-thickness ratio, the constriction of said fluid flow obstructing said flow sufficiently to create a pressure drop across the vapor film area as well as retard and thereby minimize the passage of liquid while permitting the acceleration of the passage of vapor across said vapor film area, the length of said constriction being relatively short longitudinally of said fluid flow and greater than the constricted dimension of said vapor film area transversely of said fluid flow, conducting said fluid flow through an enlarged heating zone so as to decelerate the passage of said fluid and thereby elevate its temperature.

31. The method defined in claim 30 wherein the flow of the fluid is conducted through the heating zone upstream of the constriction of flow so as preheat said fluid and amplify its vaporization.

32. The method defined in claim 30 wherein the flow of the fluid is conducted through the heating zone downstream of the constriction of flow so as to superheat said fluid and thereby minimize subsequent liquefying thereof.

33. The method as defined in claim 30 wherein the fluid flow is conducted through the heating zone upstream of the flow constriction so as to preheat the fluid and amplify its vaporization said fluid flow being conducted through another enlarged heating zone downstream of said flow constriction so as to superheat said fluid and thereby minimize subsequent liquefying thereof.

* * * * *